US009506611B2

(12) United States Patent
Ramirez

(10) Patent No.: US 9,506,611 B2
(45) Date of Patent: Nov. 29, 2016

(54) RECESSED LUMINAIRE WITH SHUTTLE MECHANISM FOR ACCESS TO ELECTRICAL COMPONENTS

(71) Applicant: Rafael M. Ramirez, Brooklyn, NY (US)

(72) Inventor: Rafael M. Ramirez, Brooklyn, NY (US)

( * ) Notice: Subject to any disclaimer, the term of this patent is extended or adjusted under 35 U.S.C. 154(b) by 80 days.

(21) Appl. No.: 14/594,649

(22) Filed: Jan. 12, 2015

(65) Prior Publication Data

US 2016/0201884 A1 Jul. 14, 2016

(51) Int. Cl.

| | |
|---|---|
| ***F21S 8/02*** | (2006.01) |
| ***F21V 17/00*** | (2006.01) |
| ***F21V 29/15*** | (2015.01) |
| ***F21V 23/00*** | (2015.01) |

(52) U.S. Cl.

CPC ..... *F21S 8/026* (2013.01); *F21V 17/002* (2013.01); *F21V 23/004* (2013.01); *F21V 29/15* (2015.01)

(58) Field of Classification Search

CPC ..... F21S 8/02; F21S 8/026; F21V 21/04; F21V 21/047; F21V 21/048; F21V 21/049; F21V 23/002

See application file for complete search history.

(56) References Cited

U.S. PATENT DOCUMENTS

| | | | | |
|---|---|---|---|---|
| 3,697,742 | A * | 10/1972 | Bobrick | F21S 8/02 362/364 |
| 5,291,381 | A | 3/1994 | Price | |
| 6,036,337 | A | 3/2000 | Belfer | |
| 6,402,350 | B1 | 6/2002 | Ward | |
| 7,438,433 | B1 * | 10/2008 | Steadman | F21S 8/02 362/147 |
| 7,478,931 | B2 * | 1/2009 | Miletich | F21S 8/02 362/147 |
| 8,376,594 | B2 | 2/2013 | Park et al. | |
| 2011/0194299 | A1 * | 8/2011 | Crooks | F21V 21/30 362/427 |

* cited by examiner

*Primary Examiner* — Robert May

(74) *Attorney, Agent, or Firm* — Vincent G. LoTempio; Kloss, Stenger & LoTempio; David T. Stephenson

(57) ABSTRACT

A recessed down-light fixture having a housing with a light source aperture, a control gear assembly containing control gear, and a guidance system that allows the control gear assembly to slide and align with the light source aperture. The aperture enables passage of a light source through a barrier such as a ceiling. The housing includes a latching or locking device for release and passage of components through the aperture for maintenance or re-lamping. The control gear assembly, or internal wiring compartment, includes a stop that secures the shuttle in a position above the aperture. The control gear assembly can then be detached and pass through the aperture, providing access to electrical components and splices within the assembly. A trim ring having a concealable surface is mounted around the aperture to increase the structural integrity of the aperture, allow for plastering and painting, and to provide a finished appearance.

20 Claims, 7 Drawing Sheets

RECESSED LUMINAIRE WITH SHUTTLE MECHANISM FOR ACCESS TO ELECTRICAL COMPONENTS

FIELD OF THE INVENTION

This invention relates to a down-light and specifically to a recessed down-light fixture mounted above a light source aperture in a ceiling where part of said down-light fixture moves out from behind the ceiling to provide access to a compartment within the fixture.

BACKGROUND OF THE INVENTION

A recessed light or down-light is a light fixture that is recessed into a cavity or a plenum above a ceiling within a room or space. When installed, the down-light allows light from a lamp or other light source to shine through a light source aperture in the ceiling surface, concentrating the light in a downward direction as a broad floodlight or narrow spotlight. The down-light interior is typically difficult to reach for inspection, repair, adjustment, or replacement of lamps since the ceiling forms a physical barrier between the room side and the ceiling cavity side.

Numerous ceiling frames for lighting down-lights are known in the art. Down-lights designed for recessing in a ceiling have been available for many years and designs and styles vary. Large light source apertures for down-lights are typically required in order to facilitate access for replacement of the light source and repair or replacement of any ballast, power supply, or other driver components. Larger light source apertures also facilitate inspection of electrical connections from below the ceiling without requiring special tools, difficult procedures, or complex designs. As the physical size of lamps and other light sources has significantly decreased over time, and the output and efficiency of said sources has significantly increased, there is current consumer demand in the market for recessed light fixtures with greatly reduced light source aperture sizes. To meet this demand new technologies are needed.

Regardless of trends toward smaller light sources, which have greater visual and aesthetic qualities and desirability, the light source aperture must remain of such a size as to allow for access to the above indicated components. The minimum size of the light source aperture is typically dictated by both electrical codes and national safety standards as related to the ability to conduct inspection and repair. In most down-light designs, the light source aperture is typically large enough for manual access to internal components.

A large trim ring has been a common solution to the need for accessibility for servicing and inspection of electrical components. Larger trim rings, however, often result in an appearance that is undesirable for consumers. They also add additional bulk and weight, which typically requires extra installation and finishing labor.

Another solution has been to utilize a smaller light source aperture where access to components is made possible above the ceiling, often requiring access panels located on the floor above. Remote access to power supplies and ballasts has been yet another common means of accommodating a smaller light source aperture. This approach relocates the necessary means of access to a less visible location away from the down-light, which invariably requires additional electrical wiring, construction and installation work, with increased costs as a result.

Some technological solutions that allow for a smaller light source aperture are evident in the patent literature. U.S. Pat. No. 6,402,350 discloses a down-light where a transformer housing can be pulled through an access point. A problem associated with the '350 patent lies in the difficulty of accessing the transformer housing by hand. Another problem with the '350 patent is the relative proximity of the compartment that houses the control gear to the heat producing light source, which can negatively affect the performance and lifespan of the control gear. U.S. Pat. No. 6,036,337 discloses a rotatable lamp assembly; however, the design does not, and is not, intended to improve access to components within the fixture. The side walls of the assembly of the '337 device have tracks on which the fixture can rotate. The '337 fixture only moves along the tracks in a rotational manner to alter the projection of light and provide different types of lighting.

U.S. Pat. No. 8,376,594 discloses a down-light having an assembly disposed in a housing, where a carriage moves along track and the socket can move horizontally or vertically. The '594 patent does not disclose a means for moving the electrical components into a position aligned with the light source aperture. U.S. Pat. No. 5,291,381 relates to a lighting fixture with a mounting system in which the components are not detached from the fixture (or the mount) and, therefore, cannot fall to the floor when being removed or installed and cannot be misplaced. The '381 patent does not disclose a means for repositioning components during removal from the fixture.

Thus, it is readily apparent that there is a need for a small light source aperture recessed down-light fixture that provides easy access for servicing of components behind the ceiling barriers. Also needed is a down-light fixture that can increase the lifespan of the control gear by distancing control gear components from the heat produced by the light source, but still allow all critical components to be accessible for servicing and inspection.

SUMMARY OF THE INVENTION

The present disclosure describes a down-light having components that can be separated during removal from behind a barrier such as a drywall ceiling and the like. Separating the components of the down-light during removal allows for a smaller light source aperture in the barrier. With currently available technologies, a light source aperture large enough to remove both the light source and electrical components simultaneously is typically required. The present disclosure describes a light source and electrical components that can be easily removed through the light source aperture in sequence as separate parts. This separation is accomplished through the use of a sliding shuttle adjacent to the light source. After the light source is removed, the shuttle is shifted to position the control gear assembly over the light source aperture. The control gear assembly can then be detached from the shuttle and removed through the light source aperture from behind the barrier.

It is accordingly a primary object of the present disclosure to provide a recessed down-light with a wiring compartment, also herein referred to as a control gear assembly, which can be removed through a small light source aperture from behind a barrier such as a ceiling or wall. The down-light includes an operatively connected light source and a control gear assembly that removably attaches to a mobile shuttle allowing these components to be positioned over the light source aperture. The control gear assembly detaches from the shuttle and can be pulled downward through the light source aperture; thereby enabling access to electrical components for inspection, repair, and replacements.

One advantage of the present disclosure is that it allows the control gear, including the ballast, or power supply, to sit in a location at a significant distance from the heat producing light source. The components inside the control gear enclosure are typically sensitive to heat, and prone to permanent damage or failure if operated at elevated temperatures. In situations where the control gear includes any kind of thermal protection devices, elevated temperatures often cause the fixture unintentionally turn on and off, in what is known in the industry as "nuisance tripping."

Ceiling cavities typically have the highest temperatures within any given room, as heat rises, so the elevated ambient temperatures add to the heat that the control gear itself produces. These elevated temperatures can cause the control gear to run at close to, or even above, its maximum recommended operating temperature. Proximity to a heat source like a hot lamp may often provide extra thermal energy that can cause components to fail.

Proximity of both the lamp and the control gear to the light source aperture is a common design feature in the light fixture industry. The design of the present disclosure, however, offers a unique advantage by allowing the distance between the control gear and the light source to be increased or decreased by varying the horizontal fixture length and shuttle location behind the ceiling. The ability to adjust the distance between the control gear and the light source allows the operating temperatures of sensitive components within the control gear assembly to be optimized, while maintaining accessibility to these components. Further, the present disclosure allows for changes in distance between sensitive components and the light source without increasing the vertical height of the recessed fixture housing, which could require an undesirable reduction in ceiling height.

The control gear assembly is removably attached to the shuttle and moves with the shuttle when attached, whereas the light source is not directly attached to the shuttle other than being tethered by a wire or electrical cable. The light source is removable without moving the shuttle. Independent movement between components and the shuttle allows the light source and various electrical components to pass through the light source aperture for easy access, rather than requiring a more difficult to reach and larger access behind the barrier. Further, since the light source does not have to be accessed from behind the barrier, a large light source aperture and trim ring are not required. Rather, a smaller light source aperture with a more aesthetically designed trim ring than would normally be required can be used. A smaller light source aperture obviates the need for a larger, less aesthetically appealing trim ring while complying with all required codes and standards for accessibility of internal components and connections behind the barrier.

Various types of light sources are compatible with the down-light of the present disclosure. These light sources include a lamp, a bulb, a light emitting diode (LED), a metal halide lamp, a halogen lamp, an incandescent lamp, or a fluorescent lamp, and additional ceiling lights known in the art. In one embodiment of the present disclosure, the light source is comprised of light-emitting diodes (LEDs) and a heat sink. Alternative embodiments of the present disclosure include the use of various styles of lamp holders and light sources, such as a reflector-style lamp holder and lamps.

The trim detail of the present disclosure may, in one embodiment, have a textured surface to promote better adhesion to plaster, spackle or similar filler materials, and paint. This method of installing and finishing the trim ring, where the trim ring is covered with a finishing material to make it unnoticeable, results in a true "trimless" appearance once the fixture installation is completed.

One object of the invention is to provide a down-light built using a variety of lamps and light sources that is suitable for mounting in a multiplicity of ceiling arrangements or wall conditions.

Another object of the invention is to provide a down-light that presents a small light source aperture in a ceiling. The smaller light source light source aperture obviates the need for a large trim ring covering the light source aperture.

A further object of the invention is to provide a down-light configured so that tools are not necessarily required to access the light source, control gear assembly, or shuttle.

A further object of the invention is to provide a down-light where the control gear assembly is on a sliding shuttle allowing components to be positioned above the light source aperture, thereby providing ready access to all components for inspection, replacement or repair.

A further object of the invention is to provide a down-light where a thermal protection device is attached to a removable plate attached to the shuttle allowing it to move into view through the light source aperture for inspection, repair, or replacement.

A further object of the invention is to provide a down-light where a light source, a cable, and associated wiring are attached to and strain-relieved to a removable control gear mounting plate attached to the shuttle. This arrangement allows the control gear assembly to move into view through the light source aperture, separate from the shuttle, and pass through the light source aperture to be accessible for inspection, repair, or replacement.

A further object of the invention is to provide a down-light where the attachment point for the cable is on a removable control gear assembly.

Yet another object of the invention is to provide a down-light having a guidance system that leads to the light source aperture for the shuttle to follow. The guidance system, in one embodiment, consists of tracks along a housing configured to allow both the light source and control gear assembly to be positioned over the light source aperture for removal.

Additional objects and advantages will become apparent, and a more thorough and comprehensive understanding may be had, from the following description and claims taken in conjunction with the accompanying drawings forming a part of this specification.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 1A:
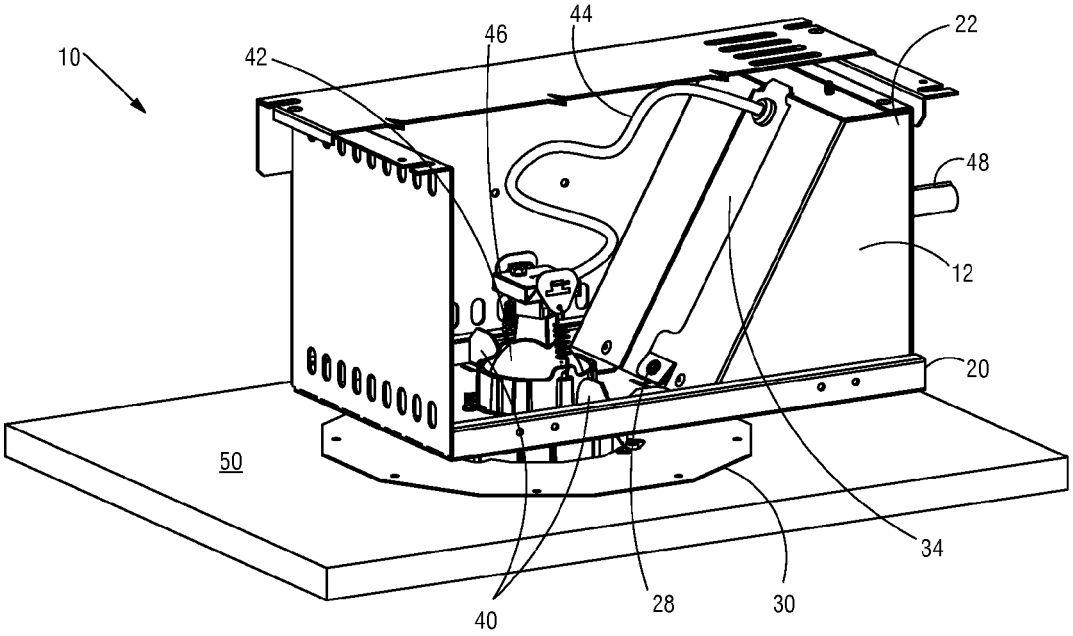
FIGS. 1A, 1B, 1C, 1D, and 1E are top perspective views of an exemplary down-light, where an exemplary control gear assembly and shuttle move from an initial point to an exemplary light source aperture before passing through an exemplary barrier.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112. As used in the following description, the terms "horizontal", "vertical", "left", "right", "up", "down", as well as adjectival and adverbial derivatives thereof (e.g., "horizontally", "vertically", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

As referenced in FIGS. 1A-4C, a down-light 10 mounts behind a barrier 50 and passes through the barrier 50 to enable access to a light source 42 and a control gear assembly 34, which includes the control gear 38 and the plate 36, the cable 44. The barrier 50 may include, without limitation, a ceiling, a wall, a door, a cabinet, a shelf, a display unit and a stage. The down-light 10 passes from behind the barrier 50 to enable access for inspection, repair, or replacement. In this manner, accessing the down-light 10 behind the barrier 50 is not necessary, since the internal mechanism of down-light 10 allows critical components to pass from behind the barrier 50. Another advantage that the down-light 10 allows is that the space in barrier 50 through which the light source 42 passes, herein referred to as a passage point or light source aperture 24, is maintained at a minimal size. Specifically, the mobility of the light source 42 allows for a smaller light source aperture 24 than would normally be required, without the use of a larger, less aesthetic trim ring. Rather, a smaller trim ring 30 is used around the light source aperture 24 while still complying with all required codes and standards for accessibility of internal components and connections.

Figure 1B:
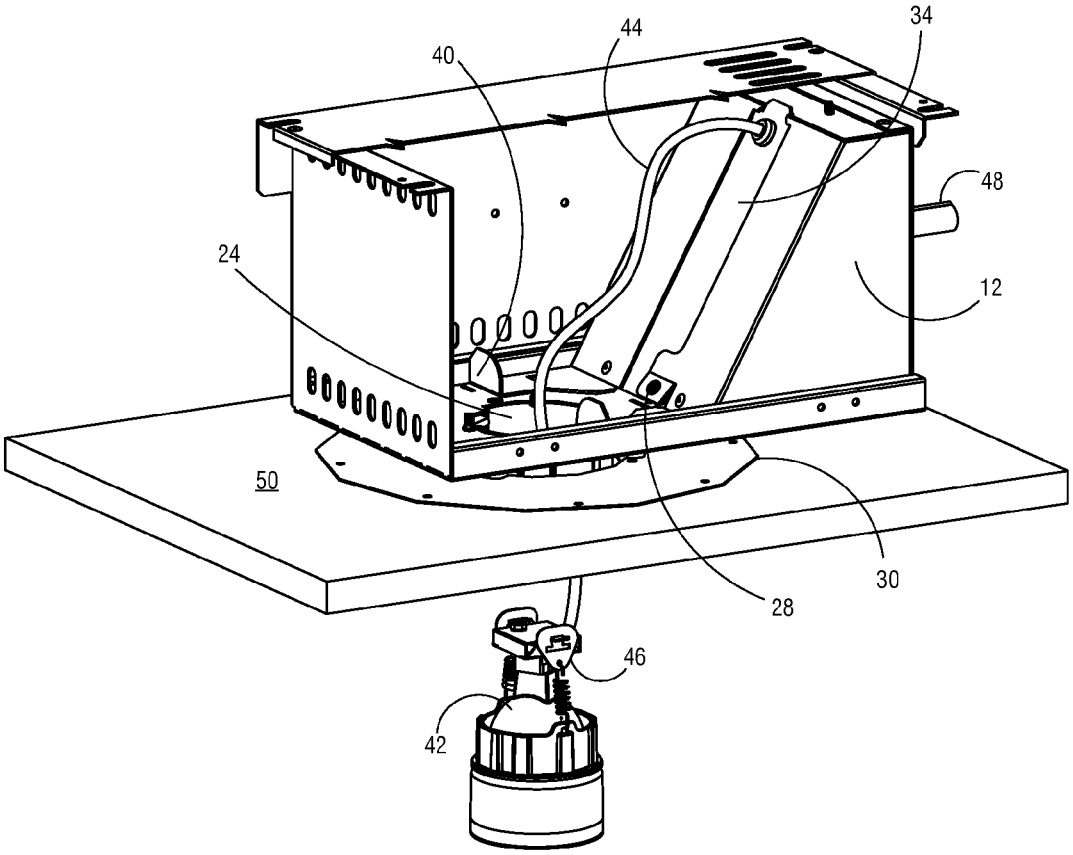

FIG. 1A illustrates a recessed down-light 10 positioned behind the barrier 50. The internal mechanism of release allows internal components of the down-light 10 to move from behind the barrier 50 through a small light source aperture 24 (as shown in FIG. 1B) to enable access to the light source 42 and associated electrical components. The capacity to move the light source 42 from behind the barrier 50, rather than accessing the light source 42 behind the barrier 50, facilitates inspection, maintenance, and replacement of the light source 42 and electrical components; and also allows for use of a smaller light source aperture 24 through the barrier 50. The down-light 10 is suitable for mounting in a multiplicity of ceiling arrangements, lighting styles, and wall conditions.

In FIG. 1B, the light source 42 passes through the light source aperture 24 independently of the other components in the down-light 10 to provide access. The light source 42 is tethered to a cable 44, so as not to completely separate from the control gear assembly 34. The light source 42 only connects to the shuttle 12 via the cable 44 and does not connect directly to the shuttle 12, while the control gear assembly 34 connects to moveable shuttle 12, while maintaining independent movement through the barrier 50. The entire unit, including the shuttle 12, may be surrounded by a housing 20 (as shown in FIG. 1E) when installed. The shuttle 12 positions behind the barrier 50, in a generally nonvisible area. The shuttle 12 forms a mounting frame for a wiring compartment for electrical components of the down-light 10.

Figure 1C:
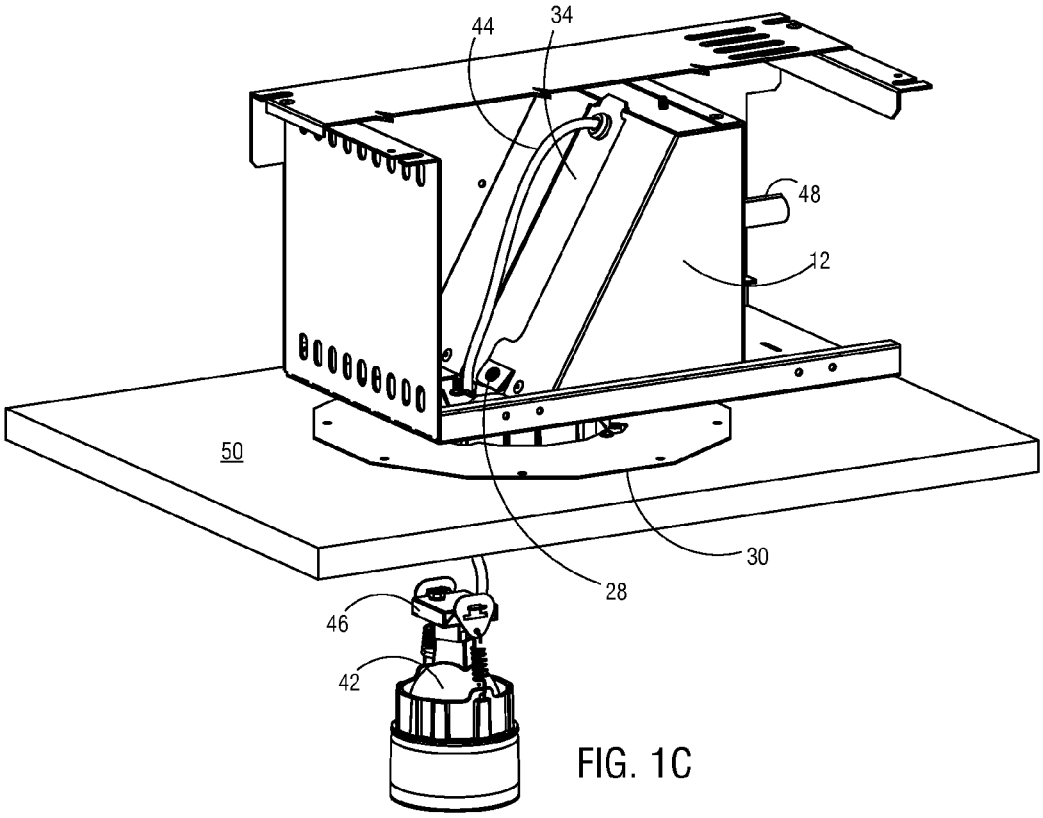

FIG. 1C illustrates the shuttle 12 slidably moving above the barrier 50 where the bottom end of housing 20 contains tracks to guide the shuttle 12 to a position over the light source aperture 24. This process, where the shuttle 12 shifts over, puts the shuttle 12 in a position to where the control gear assembly 34 can be removed through the barrier 50. In one embodiment, the shuttle 12 takes a substantially trapezoidal shape and is fabricated from a rigid metal material, such as aluminum. However, any number of materials may be used to fabricate the shuttle 12. A thermal protector 48 may be included to provide a means of safety should the ceiling cavity become too hot.

Figure 1D:
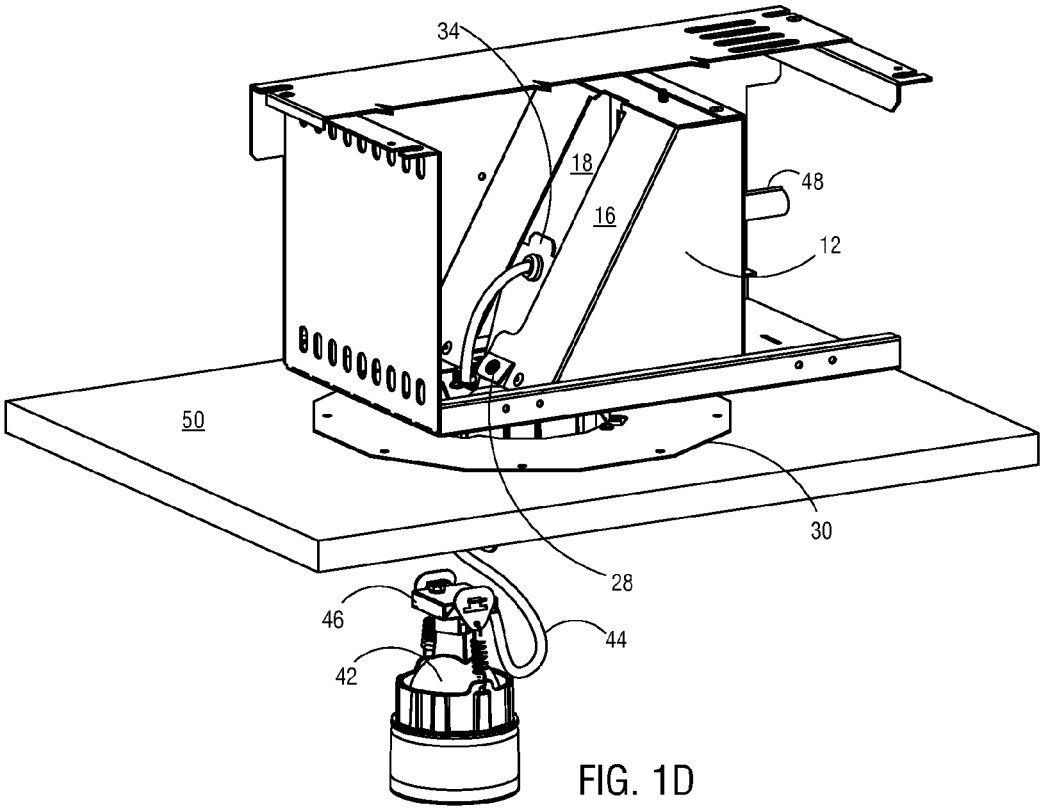
Figure 1E:
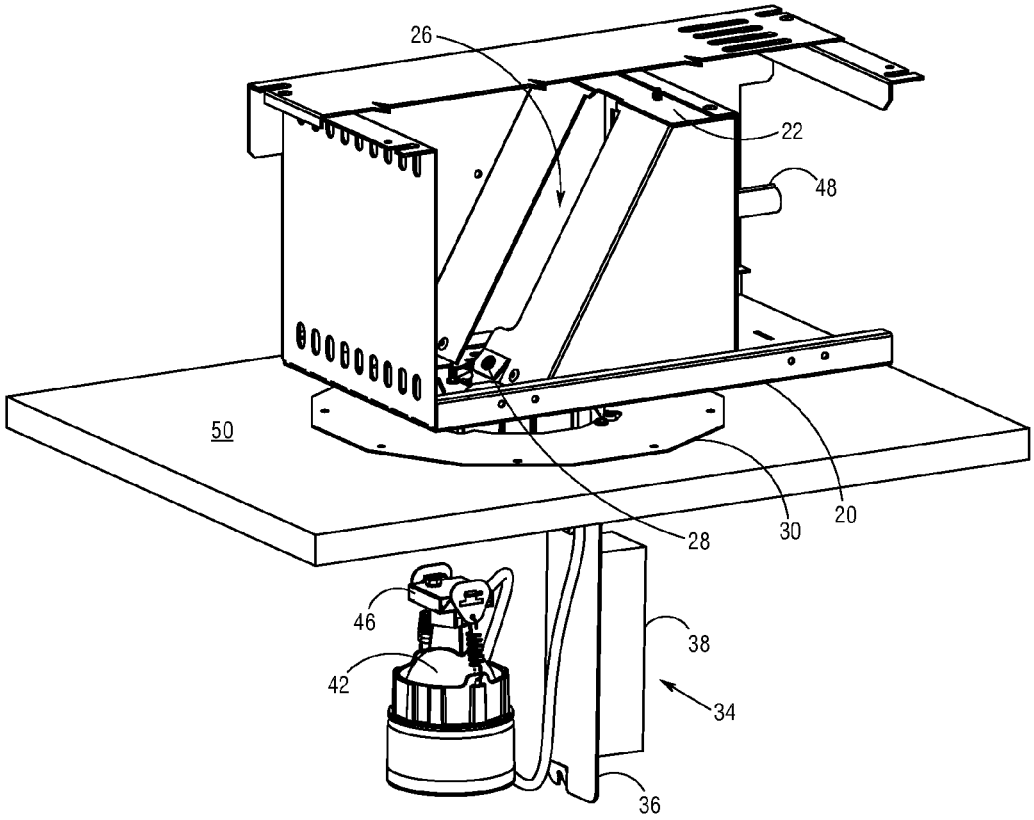

A control gear assembly 34 detachably joins within a slot 26 in the shuttle 12 (as shown in FIGS. 1D and 1E). The control gear 38 is mounted to a plate 36 that has a substantially rectangular shape. Plate 36 is sized and dimensioned to fit inside the slot 26 formed in the shuttle 12. The control gear 38 is held into place by plate 36 (as shown in FIG. 1E).

As illustrated in FIG. 1B, the tabs 40 are on the bottom end of the shuttle 12. The tabs 40 are defined by protruding members that extend from the shuttle 12. The tabs 40 serve as a grip for sliding the shuttle 12 into position over the light source aperture to access the control gear assembly 34. In this manner, the control gear assembly 34 can separate from the shuttle 12 and pass through the light source aperture 24. FIG. 1E illustrates both the control gear assembly 34 and the light source 42 separated from the shuttle 12 and accessible from in front of the barrier 50 for inspection, repair, and replacement.

FIGS. 1D and 1E illustrate the shuttle 12 and the shuttle exterior 22 (as shown in FIG. 1E) which includes an outer surface 16 and an inner surface 18. The inner surface 18 acts as enclosure for electrical components. The light source 42 may include, without limitation, a lamp, a bulb, a light emitting diode (LED), a metal halide lamp, a halogen lamp, an incandescent lamp, or a fluorescent lamp, and ceiling lights generally known in the art. The components that comprise the control gear 38 may include, without limitation, wiring, resistors, capacitors, junctions, ballasts, LED drivers, processors, power supplies, transformers and the like. A slot 26 (as shown in FIG. 1E) extends along a central section of the shuttle 12. The slot 26 forms a passage way between the inner surface 18 and the outer surface 16.

The shuttle 12 moves along a track that extends along the barrier 50. The mechanism for moving the shuttle 12 is manual in the preferred embodiment illustrated here; however, in certain embodiments the mechanism for moving the shuttle may be motorized. The shuttle 12 moves between an initial point and the light source aperture 24 in the barrier 50. The automated functionality of the mechanism for moving shuttle 12 makes it such that no tools are required to access the light source 42, control gear assembly 34, or shuttle 12.

Figure 2:
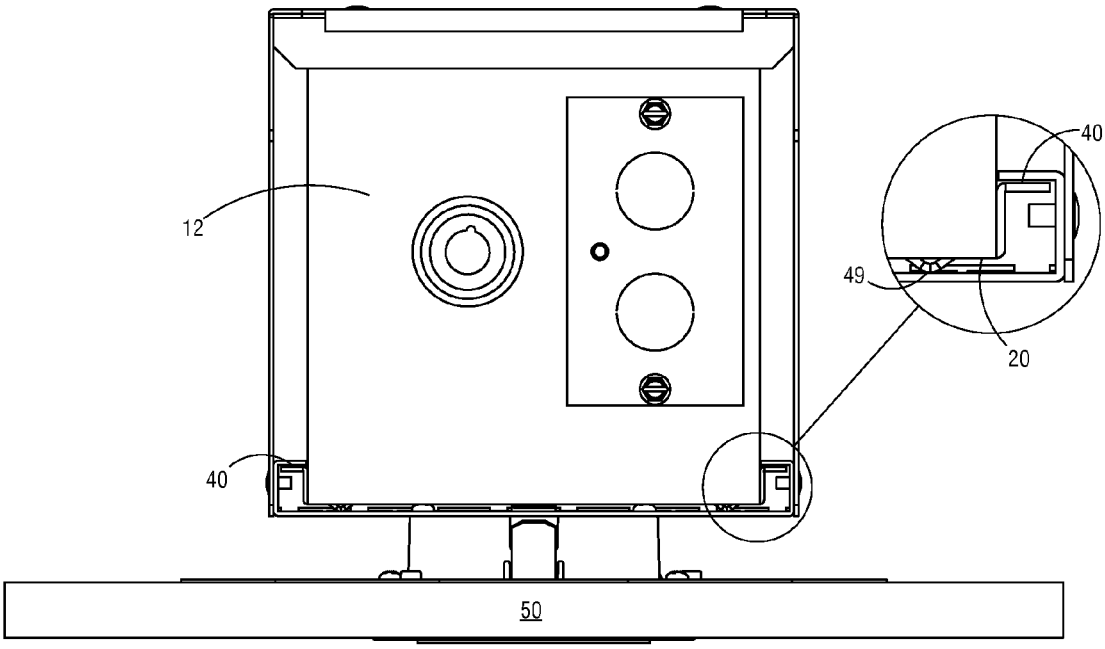
FIG. 2 is an elevated side view of an exemplary shuttle, with a magnified view of an exemplary track mechanism that the shuttle moves along.

The shuttle 12 follows the linear track between the initial point and the light source aperture 24. The linear track terminates at a stop mechanism 49 (as shown in FIG. 2), which is configured to restrict movement of the shuttle 12 beyond the light source aperture 24. In this manner, the control gear assembly 34 and the light source 42 and standard lamp holder 46 can be positioned directly over the light source aperture 24.

The stop mechanism 49 secures the shuttle 12 against the light source aperture 24, while requiring a force to be applied to allow movement of the shuttle 12 back to the initial point. In one embodiment, the stop mechanism 49 is a ball bearing plunger incorporating a body and a spring loaded ball or pin to regulate movement of the shuttle 12. In this embodiment, the ball seats into a notch in the shuttle 12, until such time as sufficient pressure is applied to enable the ball to retract into the shuttle 12, thereby allowing the shuttle 12 to move freely between the initial point and the light source aperture 24.

The light source aperture 24 is positioned in relation to the shuttle 12 to enable passage of the control gear assembly 34 and the light source 42 through the barrier 50. It is significant to note that the present invention is effective in maintaining a smaller light source aperture 24 because the control gear assembly 34 does not have to be accessed from behind the barrier 50. Rather, the control gear assembly 34 is shuttled over barrier 50 to the light source aperture 24. The smaller light source aperture 24 eliminates the need for a larger, unsightly trim ring to cover a large light source aperture in the ceiling. Yet, all required codes and standards for accessibility of internal electrical components and connections behind the barrier 50 are met with the smaller light source aperture 24.

In some embodiments, the control gear assembly 34 detachably joins within the slot 26 in the shuttle 12 and has a substantially rectangular shape, which is sized and dimensioned to fit inside the slot 26 formed in the shuttle 12. The control gear assembly 34 is held into place chiefly through a plate 36. The plate 36 is located proximate to the outer surface 16 of the shuttle 12, engaging the inner surface 18 along the longitudinal axis of the slot 26.

As referenced in FIG. 2, the stop mechanism 49 of shuttle 12 serves to locate and retain the shuttle 12 in a desired position relative to the light source aperture 24. The stop mechanism 49 engages the tab 40 on the bottom end of housing 20 of the shuttle 12. The tab 40 is defined by a protruding member that extends from the bottom end of housing 20 of the shuttle 12. In some embodiments, there may be a second stop for locating and retaining the shuttle 12 in a desired position. Control gear assembly fastener 28 (shown in FIG. 1E) removably attaches the control gear assembly 34 to the shuttle 12. Mechanical force is utilized to pull the control gear assembly 34 in a downward direction in relation to the shuttle 12.

Figure 1F:
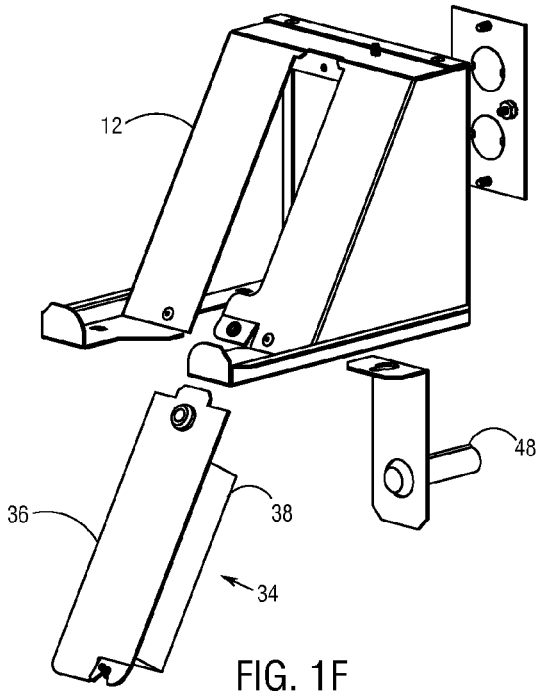
FIG. 1F is an exploded view of the shuttle and associated components.

FIG. 1F shows the control gear assembly 34 separated from shuttle 12 and thermal protector 48.

FIG. 2 is an elevated side view of shuttle 12, with a magnified view of a track mechanism that the shuttle moves along. Illustrated is a stop mechanism 49, which engages the tab 40. The shuttle housing 20 is shown in the magnified view adjacent to tab 40 and stop mechanism 49.

Figure 3:
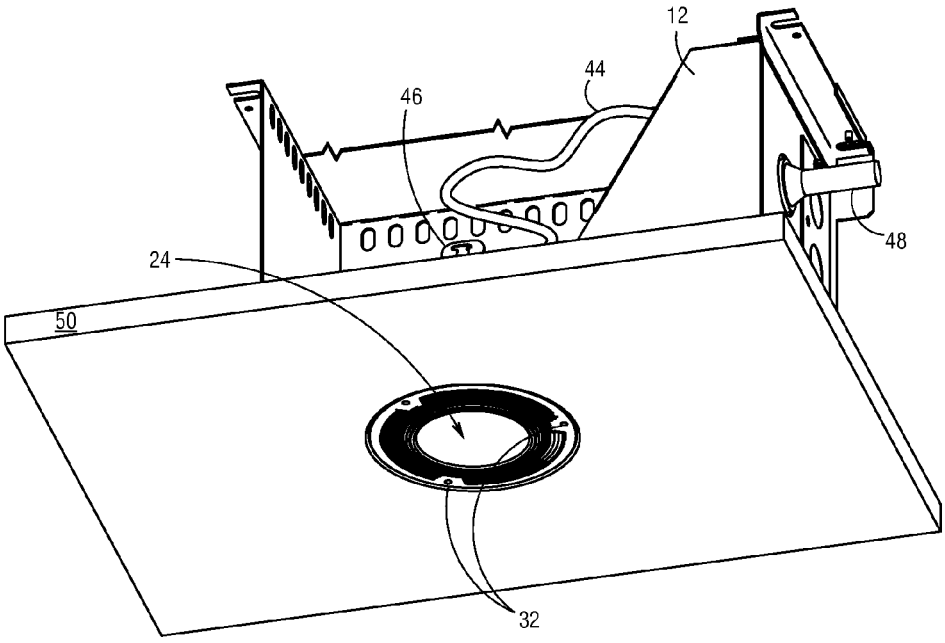
FIG. 3 is a bottom perspective view of the down-light, showing an exemplary trim ring fastening the down-light to the barrier.

FIG. 3 illustrates light source aperture 24 surrounded by trim ring 30 (shown in FIGS. 4A, 4B, 4C and 6). The trim ring 30 mounts around the light source aperture 24, forming a rigid periphery to increase the structural integrity of the light source aperture 24 and also serve as a guide for the light source 42 moving through the light source aperture 24. The trim ring 30 may include a plurality of holes 32 spaced around the trim ring 30 for receiving fasteners, such as bolts or screws. The fasteners pass through the barrier 50 and the holes 32 to secure the trim ring 30 into place around the light source aperture 24. The holes 32 can have different heights and spacing to enable adjustments to the trim ring 30.

Figure 4A:
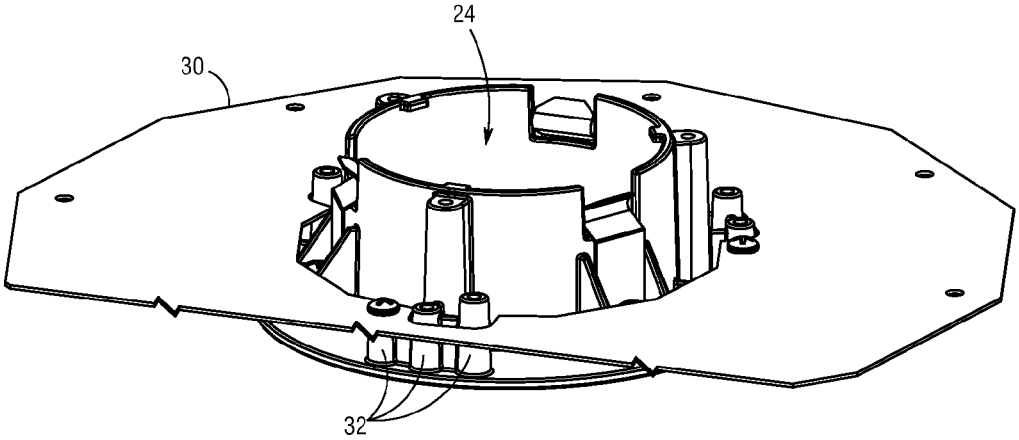
FIGS. 4A, 4B, and 4C are perspective views of an exemplary trim ring showing the various holes and fasteners for adjusting the height and orientation of the trim ring.
Figure 4B:
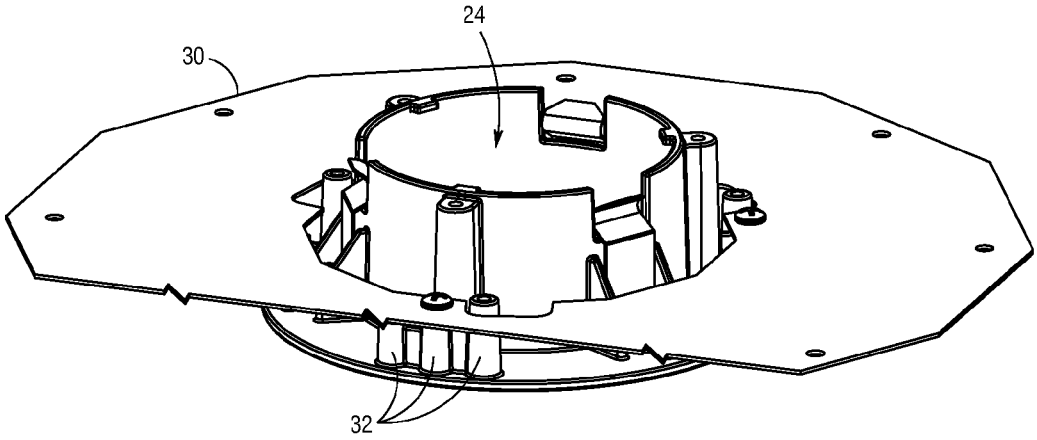
Figure 4C:
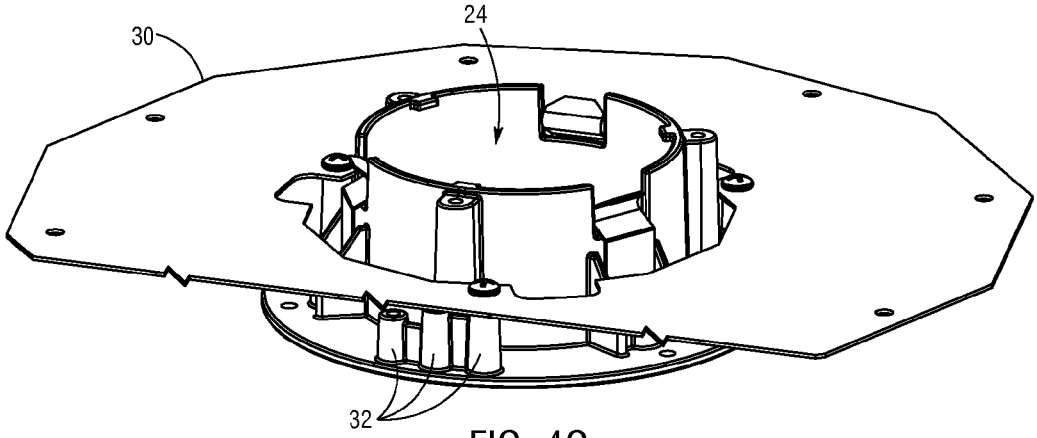

FIGS. 4A, 4B, and 4C show the trim ring 30 being adjusted around the light source aperture 24 to create variable heights and orientations for the trim ring 30 in relation to the barrier 50. This adjustability enhances the decorative effect and provides a better fitting for the down-light 10 when integrated into barriers 50 of various thicknesses. In some embodiments, the trim ring 30 has a plurality of holes 32 through which fasteners can pass through for rotatably adjusting the height and orientation of the trim ring 30. The fasteners can include any bolt, screw, or rod known in the ceiling accessories industry. In one embodiment, the trim ring 30 is an aluminum cover that encircles the light source aperture 24, from both sides of the barrier 50.

Figure 5A:
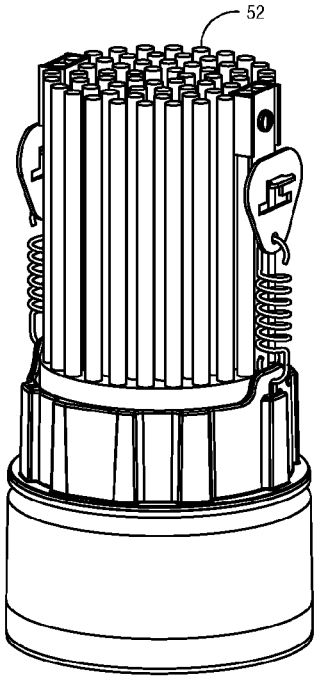
FIGS. 5A, 5B and 5C show a perspective and exploded view of an alternative embodiment of the light source that includes LEDs and a heat sink.
Figure 5B:
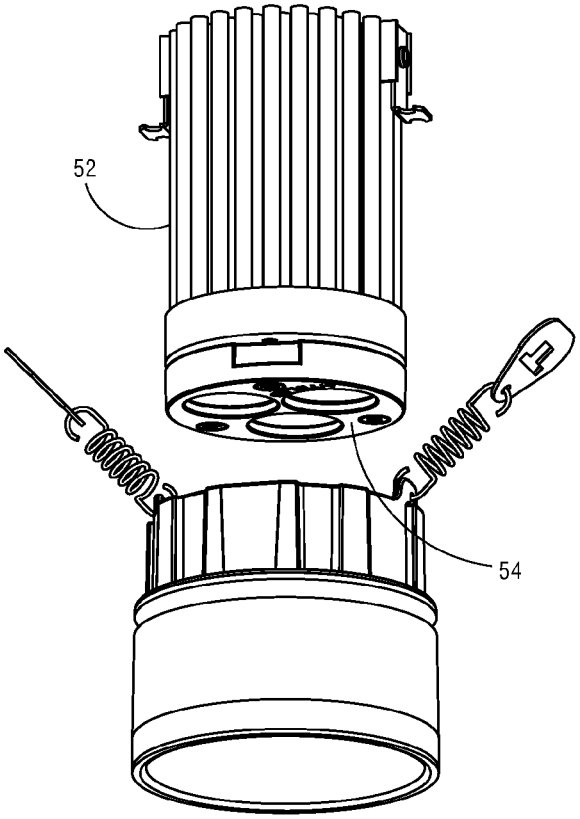
Figure 5C:
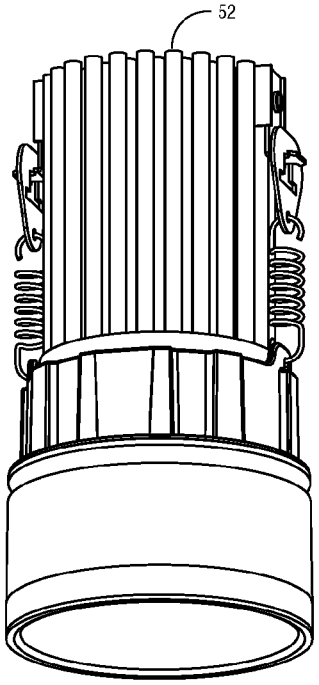
Figure 5D:
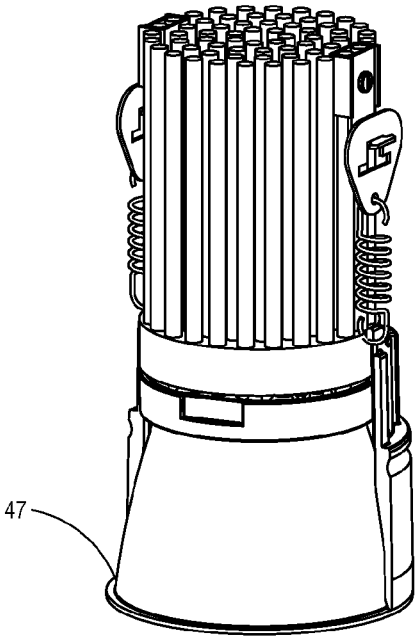
FIG. 5D shows perspective views of an alternative embodiment of the light source that includes LEDs, a heat sink and also including a reflector-style lamp holder.

FIGS. 5A, 5B and 5C show an alternative embodiment of the present disclosure that includes the use of LEDs 54 and a heat sink 52. FIG. 5D shows an alternative embodiment that includes a reflector-style lamp holder 47.

Figure 6:
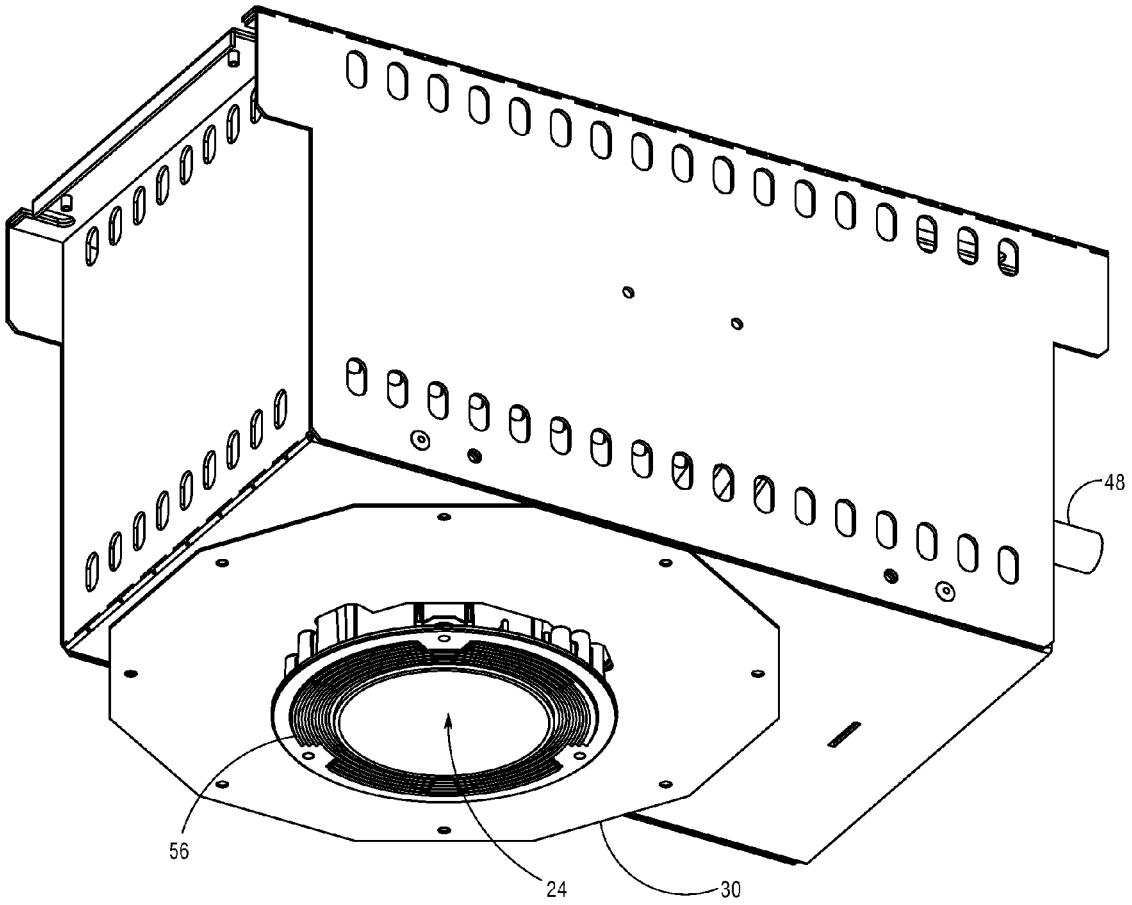
FIG. 6 is a perspective view of an exemplary trim ring showing a concealable surface on the trim detail.
Figure 7:
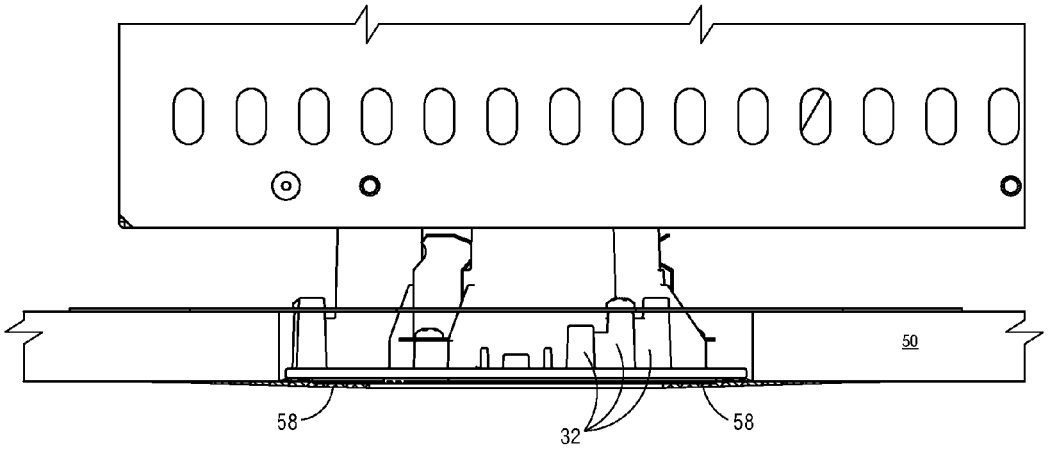
FIG. 7 is a cross sectional side view illustrating a thin plaster coat on the trim ring.

FIGS. 6 and 7 show an embodiment of the present invention that includes a trim detail, the exposed area of the trim at the visible side of the barrier, having a concealable surface 56. The concealable surface 56 of the trim detail may have a textured surface that allows for and facilitates its being covered with plaster, spackle or similar filler material and paint. This method of installing and finishing the trim ring 30, where the trim detail is covered with material to make it unnoticeable, results in a true "trimless" appearance once the fixture installation is completed. In the typical "trimless" installation as disclosed herein, the only visible aspect of the down-light 10, as seen from below, is light source aperture 24 in the barrier 50 containing the light source 42. With the "trimless" design, the surrounding region of light source aperture 24 is relatively thin and has a concealable surface 56 which may be roughened, perforated or the like to facilitate binding to the cover material. A concealable surface 56 is useful for embedding in and enhancing the adhesion to a plaster coat 58, drywall compound or similar materials, and may also be coated with a chemical coating to further enhance the adhesion.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A down-light comprising: a shuttle including an outer surface and an inner surface, the shuttle having a control gear assembly detachably joined within a slot in the shuttle, the shuttle positioned along a guidance system configured to carry the shuttle along a linear track of a housing from an initial point to a point directly over a light source aperture such that the slot and the control gear can be removed through the light source aperture without inserting an entire hand through light source aperture: wherein the-control gear assembly is operatively connected to the light source; the light Source aperture configured to enable passage of a light source through a barrier and a trim ring that mounts around the light source aperture, the trim ring forming a rigid periphery to increase the structural integrity of the light source aperture.

2. The down-light of claim 1, wherein the barrier is a generally planar surface of a room.

3. The down-light of claim 2, wherein the shuttle slidingly engages the linear track within the housing.

4. The down-light of claim 1, wherein said guidance system directs movement of the shuttle along the track.

5. The down-light of claim 4, wherein the track terminates at a stop mechanism configured to restrict movement of the shuttle beyond the light source aperture.

6. The down-light of claim 5, wherein the stop mechanism includes a spring loaded ball to regulate movement of the shuttle.

7. The down-light of claim 6, wherein the ball seats into a notch in the shuttle.

8. The down-light of claim 1, wherein the control gear assembly is removably attached to the shuttle.

9. The down-light of claim 8, wherein a removably attached control gear fastener retains the control gear assembly in the shuttle.

10. The down-light of claim 9, wherein a cable extends between the control gear assembly and the light source, the cable configured to transfer electrical power.

11. The down-light of claim 10, wherein the cable tethers the light source to the control gear assembly, the cable configured to allow removal of the light source consecutively with the control gear assembly.

12. The down-light of claim 11, wherein the light source is comprised of light-emitting diodes.

13. The down-light of claim 1, wherein the trim ring is a cover that encircles the light source aperture.

14. The down-light of claim 1, wherein the trim ring has a trim detail having a concealable outer surface.

15. The down-light of claim 1, wherein the trim ring has an adjustable height and orientation.

16. The down-light of claim 15, wherein the trim ring includes a plurality of holes spaced around the trim ring for receiving a plurality of trim ring fasteners, wherein the trim ring fasteners pass through the barrier and the holes in order to secure the trim ring into place around the light source aperture.

17. The down-light of claim 16, wherein the holes vary in height to enable adjustments to the trim ring.

18. A method of accessing a recessed down-light assembly from behind a barrier comprising:

removing a light source through a light source aperture;

guiding a shuttle along a linear track within a housing to position a removably attached control gear assembly vertically in line with the light source aperture;

mechanically releasing the control gear assembly from a slot in the shuttle;

detaching the control gear assembly from the shuttle; and pulling down the control gear assembly through the light source aperture.

19. The method of claim 18, further comprising:

moving the control gear assembly away from the light source to separate the light source and the control gear assembly in order to provide distance between the light source and the control gear assembly to prevent damage to the control gear caused by heat from the light source, and varying a distance between the control gear assembly and the light source to optimize an operating temperature of the control gear assembly.

20. A down-light comprising:

a shuttle including an outer surface and an inner surface, the shuttle positioned along a guidance system configured to carry the shuttle from an initial point to a light source aperture, the light source aperture configured to enable passage of a light source through a barrier;

a trim ring that mounts around the light source aperture, the trim ring forming a rigid periphery to increase the structural integrity of the light source aperture; and a control gear assembly detachably joined within a slot in the shuttle, wherein the control gear assembly is configured to pull down out of the slot and pass through the light source aperture, wherein the control gear assembly is operatively connected to the light source; and wherein the trim ring has an adjustable height and orientation; wherein the trim ring includes a plurality of holes spaced around the trim ring for receiving a plurality of trim ring fasteners, wherein the trim ring fasteners pass through the barrier and the holes in order to secure the trim ring into place around the light source aperture; wherein the holes vary in height to enable adjustments to the trim ring.

* * * * *